US009010379B2

(12) United States Patent
Gothard et al.

(10) Patent No.: US 9,010,379 B2
(45) Date of Patent: Apr. 21, 2015

(54) APPARATUS AND METHOD FOR ENTRAINING FLUIDS

(75) Inventors: Michelle Gothard, Royston (GB); Nicholas Cousins, Girton (GB); Robert Scott, Godmanchester (GB)

(73) Assignee: Pursuit Marine Drive Limited, Huntingdon, Cambridgeshire (GB)

( * ) Notice: Subject to any disclaimer, the term of this patent is extended or adjusted under 35 U.S.C. 154(b) by 103 days.

(21) Appl. No.: 13/575,186

(22) PCT Filed: Feb. 17, 2011

(86) PCT No.: PCT/GB2011/000224
§ 371 (c)(1),
(2), (4) Date: Sep. 19, 2012

(87) PCT Pub. No.: WO2011/101637
PCT Pub. Date: Aug. 25, 2011

(65) Prior Publication Data

US 2013/0000733 A1 Jan. 3, 2013

(30) Foreign Application Priority Data

Feb. 17, 2010 (GB) ..... 1002666.4

(51) Int. Cl.
*B01F 5/04* (2006.01)
*F04F 5/46* (2006.01)
(Continued)

(52) U.S. Cl.
CPC ..... *B01F 3/0807* (2013.01); *B01F 5/0262* (2013.01); *B01F 13/1016* (2013.01); *B01F 13/1022* (2013.01); *B01F 5/0426* (2013.01)

(58) Field of Classification Search
CPC .... B01F 5/0413; B01F 5/0425; B01F 5/0426; B01F 5/043
USPC ..... 137/889, 3, 896, 897, 898, 892, 893, 137/895, 888, 890; 417/174; 239/398; 366/163.2
See application file for complete search history.

(56) References Cited

U.S. PATENT DOCUMENTS 2,747,934 A 5/1956 Fisher
2,979,066 A * 4/1961 Christie ..... 137/3
(Continued)

FOREIGN PATENT DOCUMENTS

AU 627 043 8/1992
EP 0 854 295 7/1998
(Continued)

OTHER PUBLICATIONS

Raw Machine Translation of EP0854295 (A1) [Pub. Jul. 22, 1998] provided by the EPO.*

*Primary Examiner* — John Rivell
*Assistant Examiner* — David Colon Morales
(74) *Attorney, Agent, or Firm* — Bryan Cave LLP

(57) ABSTRACT

A method of entraining a second fluid in a first fluid is provided. The method comprises supplying a first fluid to a processing passage (4) having an inlet (6) and an outlet (8), and supplying an entrainment fluid to a nozzle (10) which opens into the processing passage (4) intermediate the passage inlet (6) and the passage outlet (8). A second fluid which will undergo a change of phase and/or state when added to the first fluid is also provided, and supplied to a first port (22) opening into the processing passage (4) adjacent the nozzle (10). The entrainment fluid is injected from the nozzle (10) into the processing passage (4) so as to form a dispersed phase of the first and second fluids in a continuous vapor phase, and the vapor phase is condensed downstream of the nozzle (10). A device suitable for carrying out such a method is also provided.

13 Claims, 9 Drawing Sheets

(51) Int. Cl.

| | |
|---|---|
| ***B01F 3/08*** | (2006.01) |
| ***B01F 5/02*** | (2006.01) |
| ***B01F 13/10*** | (2006.01) |

(56) References Cited

U.S. PATENT DOCUMENTS

| | | | | |
|---|---|---|---|---|
| 5,275,486 | A * | 1/1994 | Fissenko | 366/178.3 |
| 5,338,113 | A * | 8/1994 | Fissenko | 366/178.2 |
| 5,544,961 | A * | 8/1996 | Fuks et al. | 366/163.2 |
| 6,004,024 | A * | 12/1999 | Ho et al. | 366/167.1 |
| 6,192,911 | B1 * | 2/2001 | Barnes | 137/12 |
| 6,224,778 | B1 * | 5/2001 | Peltzer | 210/739 |
| 6,299,343 | B1 * | 10/2001 | Pekerman | 366/163.2 |
| 6,523,991 | B1 * | 2/2003 | Maklad | 366/163.2 |
| 6,662,549 | B2 * | 12/2003 | Burns | 60/204 |
| 7,029,165 | B2 * | 4/2006 | Allen | 366/163.2 |
| 7,111,975 | B2 * | 9/2006 | Fenton et al. | 366/163.2 |
| 7,497,666 | B2 * | 3/2009 | Garris, Jr. | 417/182 |
| 2001/0032668 | A1 * | 10/2001 | Doty et al. | 137/93 |
| 2003/0227821 | A1 * | 12/2003 | Bae et al. | 366/163.2 |
| 2005/0029170 | A1 * | 2/2005 | Urquhart et al. | 210/96.1 |
| 2005/0061378 | A1 * | 3/2005 | Foret | 137/888 |
| 2007/0210186 | A1 * | 9/2007 | Fenton et al. | 239/422 |
| 2008/0105315 | A1 * | 5/2008 | Botros et al. | 137/819 |
| 2008/0310970 | A1 * | 12/2008 | Fenton et al. | 417/198 |
| 2009/0240088 | A1 * | 9/2009 | Fenton et al. | 568/840 |

FOREIGN PATENT DOCUMENTS

| | | |
|---|---|---|
| EP | 1 180 550 | 2/2002 |
| JP | 63 267424 | 11/1988 |

* cited by examiner

APPARATUS AND METHOD FOR ENTRAINING FLUIDS

CROSS-REFERENCES TO RELATED APPLICATIONS

This application is a U.S. National Stage Application of International Application No. PCT/GB2011/000224, which was filed on 17 Feb. 2011, and which claims priority to Great Britain Application No. 1002666.4, which was filed on 17 Feb. 2010, which is incorporated by reference in its entirety as if recited in full herein.

FIELD OF THE INVENTION

The present invention is concerned with the entrainment of a second fluid in a first fluid. More specifically, the present invention provides an apparatus and method for entraining a second fluid whose state or chemical composition means that it is typically difficult to entrain in the first fluid.

BACKGROUND OF THE INVENTION

A large number of commercial products such as, for example, foodstuffs, cleaning products, and pharmaceuticals are dependent on the formation of specific molecular and macromolecular structures. The final product structure is responsible for its appearance, functionality, stability, compatibility with other materials or processes, and toxicology. Each particular structure is built by the mixing and inclusion of specific chemical or particulate components under controlled chemical, physical and environmental conditions. The control is required because many components used in forming these structured materials are required to be in a particular phase or state when another component is added or a particular part of the process applied. When a material undergoes a change in phase or state (e.g. solid to liquid, sol to gel, helix-coil, glass to rubber, crystalline to amorphous) the point at which this occurs is called the 'phase or state transition'. The transition for a material will be determined by variables such as temperature, pressure, presence of solvent, ionic and small solute environment and concentration of the material.

Temperature is one of the key factors dictating the phase or state of many of the components commonly used on the aforementioned structured products. By way of example, heavy fats and waxes that are commonly used as polishes, emollients, surfactants and lubricants in formulation undergo a temperature dependant phase change from solid to liquid oil on heating due to disordering of small crystallites. This specific type of phase transition can be referred to as a 'melt' or 'crystallisation' dependant on the thermal direction of the process. Another predominantly thermal transition common in structured materials is the 'helix-coil transition' and this exists for a number of hydrocolloids such as Gellan Gum, Xanthan Gum and Gelatine. These biopolymers exist in their low energy state as hydrogen bonded double helices due to the specific linkage geometries between their constituent monosaccharides or amino acids. When heated, the energy input disrupts the hydrogen bonds and increases molecular motion allowing the helices to unwind and exist as free single polymers. This is the helix-coil transition. On cooling the helix-helix pairs reform, with each macromolecule pairing with one or more partners forming a cross-linked network. This ability to form network structures makes these polymers useful as viscosifiers, gelling agents and suspending agents.

Another set of transitions of importance in forming structured materials are those mediated by ionic bonding. Charged polymers such as pectins, alginate, carrageenan and low acyl Gellan are sensitive to metal cations, particularly positively charged divalent ions such as calcium. The ions bond with negatively charged sites on the polymers forming runs of crosslink between polymers called 'junction zones'. The formation of junction zones leads to an increase in viscosity or gelation by the formation of a partial or fully networked structure. Below a critical ion concentration the junction zones cannot form stable cross-links and the system may be on the sol side of the gel-sol transition.

From the phase or state transition examples given above it is evident that multi-component structured materials formed from mixtures of these systems will often have constraints placed upon the formulation, process, or possible end product. This is due to undesirable behaviours, state or phase changes occurring in one or more component. An example of such unwanted behaviour may be in trying to form an emulsion from a long chain lipid requiring a relatively high temperature melt (e.g. 70° C.), but needing to be dispersed in a viscosified fluid phase that is not stable above 40° C. Introduction of the melted lipid into the cooler fluid will result in a 'crash-cooling' event whereby the lipid will rapidly pass through its crystallisation transition forming very small crystallites and rapidly coalescing forming irregular solid aggregates rather than a fine droplet dispersion for an emulsion. Use of high shear mixing equipment such as high pressure screen emulsifiers would not be advantageous in such a scenario due to clogging of the screen by the coalesced lipid. Also the high shear environment of the homogeniser would possibly disrupt the viscosifying structure in the fluid phase.

Other negative behaviours which may occur during the mixing and entrainment of seemingly incompatible products may include coalescence, precipitation, phase inversion, incorrect partitioning of solutes or ionic species between phases or components, phase separation, and inhomogeneity.

The following example is given as an illustration of the problems associated with mixing certain materials. In this example, Material 1 has a defined temperature T (or temperature range for some compound materials such as polymers) at which a phase change occurs.

T may be a temperature at which the material goes from a solid to a liquid phase, or it may be a temperature at which the helix coil transition occurs: above this temperature the helix coils unwind, below they form a cross-linked network. T may also be the temperature at which chemical bonds or cross-links mediated by charge interactions are broken or formed. For example calcium ion mediated bonds in the formation of low methoxy pectin gels.

Normally, in order to mix material 1 with a second material ("material 2") material 2 must also be at a temperature above T, i.e. $T_2 \geq T$. This may be disadvantageous simply because to raise material 2 to this temperature requires a large amount of energy. However it also may be disadvantageous because at this temperature material 2 has also passed through a phase transition, but in this case it means that material 2 is in an undesirable phase or state (e.g. the biopolymer Xanthan gum imparts specific rheological properties to a fluid in its low temperature ordered state, allowing it to both flow and act as a suspensor. At temperatures above its helix-coil transition temperature these properties are lost). Furthermore, even if the two materials are mixed at a temperature above T, the nature of the mixture so produced may mean that it then has to be cooled under very controlled conditions (and possibly over a long time) so as to maintained the desired mixture structure. This can be undesirable for cost and energy reasons. However, conventionally, if material 2 is not heated to above T then mixing the two materials is impossible. For example, if $T_2 \leq T$ and the phase change is a melt condition, then material 1 will instantly solidify when it meets material 2. This causes a "crash cooling" event whereby the lipid will rapidly pass through its crystallisation transition forming very small crystallites and rapidly coalescing to form irregular solid aggregates.

Another example scenario would be trying to mix fluid 1 into fluid 2 where fluid 1 undergoes a phase change in the presence of a critical ionic concentration C or pH present in fluid 2 (e.g. a dispersion of low ionic strength alginate, at gelling concentration, introduced into a fluid containing calcium ions above C). The alginate would rapidly form heterogeneous gelled particulates under conventional mixing. In this example temperature may also play a role in the ability and type of mixing and structure formed on introducing fluid 1 to fluid 2 by conventional mixing methods.

SUMMARY OF THE INVENTION

One embodiment of the present invention is a method of entraining a second fluid in a first fluid, the method comprising: supplying a first fluid to a processing passage having an inlet and an outlet; supplying an entrainment fluid to a nozzle which opens into the processing passage intermediate the passage inlet and the passage outlet; providing a second fluid that will undergo a change of phase and/or state when added to the first fluid, and supplying the second fluid to a first port opening into the processing passage downstream of the nozzle; injecting the entrainment fluid from the nozzle into the processing passage so as to form a dispersed phase of the first and second fluids in a continuous vapour phase; and condensing the vapour phase downstream of the entrainment fluid nozzle.

Another embodiment of the present invention is an apparatus for entraining a second fluid in a first fluid, the apparatus comprising: a fluid processing passage having an inlet connectable to a source of the first fluid, and an outlet; a nozzle circumscribing the processing passage and opening into the processing passage intermediate the inlet and the outlet; and a first port opening into the processing passage downstream of the nozzle; wherein the apparatus further comprises an entrainment fluid supply chamber in fluid communication with the nozzle, and a second fluid supply chamber in fluid communication with the first port; and wherein the chambers are separated from one another by a wall member which at least partially defines both the entrainment fluid supply chamber and the second fluid supply chamber.

A further embodiment is a system for entraining a second fluid in a first fluid, the system comprising: an apparatus in accordance with the present invention; a first fluid supply vessel in fluid communication with the process passage inlet; an entrainment fluid supply in fluid communication with the entrainment fluid supply chamber; a second fluid supply vessel in fluid communication with the second fluid supply chamber; a plurality of control valves controlling fluid flow from the entrainment fluid supply and vessels to the apparatus; a plurality of sensors located in the process passage and supply chambers; and an electronic control unit adapted to selectively open and close the control valves in response to signals from the plurality of sensors.

It is an aim of the present invention to obviate or mitigate one or more of the aforementioned disadvantages.

DETAILED DESCRIPTION OF THE INVENTION

According to a first aspect of the invention, there is provided a method of entraining a second fluid in a first fluid, the method comprising:

supplying a first fluid to a processing passage having an inlet and an outlet;

supplying an entrainment fluid to a nozzle which opens into the processing passage intermediate the passage inlet and the passage outlet;

providing a second fluid that will undergo a change of phase and/or state when added to the first fluid, and supplying the second fluid to a first port opening into the processing passage downstream of the nozzle;

injecting the entrainment fluid from the nozzle into the processing passage so as to form a dispersed phase of the first and second fluids in a continuous vapour phase; and condensing the vapour phase downstream of the entrainment fluid nozzle.

The second fluid is a fluid which will change phase and/or state as soon as it is added to the first fluid. This may be due to the second fluid being supplied or stored in a particular phase and/or state, with a parameter of the first fluid (e.g. temperature, ionic concentration or pH level) triggering the change of phase and/or state of the second fluid from that initial phase and/or state.

The second fluid may be in the liquid phase when supplied to the first port and will at least partially solidify or crystallise when added to the first fluid.

The second fluid may have a predetermined temperature T at which the change of phase and/or state will occur, and the second fluid in the second fluid supply chamber has a temperature $T_2$, where $T_2 \geq T$, and the first fluid supplied to the processing passage has a temperature $T_1$, where $T_1 < T$. The temperatures $T_1$ and $T_2$ may be selected such that the product resulting from the processing of the first and second fluids has a temperature $T_O$ at the outlet of the passage, where $T_O < T$.

The second fluid may have a predetermined ionic concentration C such that the second fluid is in a specific phase and/or state in the second fluid supply chamber, and the first fluid supplied to the processing passage has an ionic concentration $C_1$ which is greater than or less than C. The second fluid may comprise a plurality of constituents which are in a specific phase and/or state at the predetermined ionic concentration C.

The second fluid may have a predetermined pH level P such that the second fluid is in a specific phase and/or state in the second fluid supply chamber, and the first fluid supplied to the processing passage has a pH level $P_1$ which is greater than or less than P. The second fluid may comprise a plurality of constituents which are in a specific phase and/or state at the predetermined pH level P.

The entrainment fluid and second fluid may be supplied from entrainment fluid and second fluid supply chambers, respectively, which are separated from one another by a wall member which at least partially defines both the entrainment fluid supply chamber and the second fluid supply chamber, and wherein the method further comprises maintaining the temperature $T_2$ of the second fluid in the second chamber by transferring heat from the entrainment fluid to the second fluid via the wall member. The entrainment fluid may be a gas selected from the group comprising steam, carbon dioxide, compressed air, and nitrogen.

The method may further comprise the step of supplying a third fluid into the processing passage. The third fluid may be supplied from a third fluid supply chamber to a second port opening into the processing passage downstream of the first port. Alternatively, the second port may open into the processing passage upstream of the nozzle.

According to a second aspect of the present invention, there is provided an apparatus for entraining a second fluid in a first fluid, the apparatus comprising:

a fluid processing passage having an inlet connectable to a source of the first fluid, and an outlet;

a nozzle circumscribing the processing passage and opening into the processing passage intermediate the inlet and the outlet; and a first port opening into the processing passage downstream of the nozzle;

wherein the apparatus further comprises an entrainment fluid supply chamber in fluid communication with the nozzle, and a second fluid supply chamber in fluid communication with the first port; and wherein the chambers are separated from one another by a wall member which at least partially defines both the entrainment fluid supply chamber and the second fluid supply chamber.

The wall member may be adapted to allow heat transfer from the entrainment fluid supply chamber into the second fluid supply chamber.

The apparatus may further comprise a heating element located in the second fluid supply chamber.

The inlet of the processing passage may have a first cross sectional area, and the cross sectional area of the passage does not reduce below the first cross sectional area at any point between the passage inlet and the passage outlet.

The nozzle may have a nozzle inlet, a nozzle outlet and a nozzle throat portion intermediate the nozzle inlet and nozzle outlet, the throat portion having a cross sectional area which is less than that of either the nozzle inlet or nozzle outlet.

The apparatus may further comprise an entrainment fluid supply passage upstream of the entrainment fluid supply chamber, wherein the nozzle inlet has a cross sectional area which is less than that of the entrainment fluid supply passage, and the wall member may form at least part of a funnel adapted to direct entrainment fluid from the entrainment fluid supply passage into the nozzle inlet.

The supply chambers may be annular and located radially outward of the processing passage, with the entrainment fluid supply chamber located radially outward of the second fluid supply chamber, the wall member at least partially defining the outer wall of the second fluid supply chamber and the inner wall of the entrainment fluid supply chamber.

The first port may be an annular port circumscribing the processing passage.

The apparatus may further comprise a second port opening into the passage. The apparatus may further comprise a third fluid supply chamber in fluid communication with the second port. Alternatively, the second port may be in fluid communication with the second fluid supply chamber.

The second port may open into the passage downstream of the first port. Alternatively, the second port may open into the passage upstream of the nozzle.

The second port may be an annular port circumscribing the processing passage.

According to a third aspect of the invention, there is provided a system for entraining a second fluid in a first fluid, the system comprising:

an apparatus in accordance with the second aspect of the invention;

a first fluid supply vessel in fluid communication with the process passage inlet;

an entrainment fluid supply in fluid communication with the entrainment fluid supply chamber;

a second fluid supply vessel in fluid communication with the second fluid supply chamber;

a plurality of control valves controlling fluid flow from the entrainment fluid supply and vessels to the apparatus;

a plurality of sensors located in the process passage and supply chambers; and an electronic control unit adapted to selectively open and close the control valves in response to signals from the plurality of sensors.

A preferred embodiment of the present invention will now be described, by way of example only, with reference to the accompanying drawings, in which:

DESCRIPTION OF THE DRAWINGS

FIG. 1 shows a vertical section through an apparatus for entraining a second process fluid in a first process fluid. The apparatus, generally designated 1, has a body 2 in which a number of passages are defined. The body 2 and the passages therein may be formed from a single piece of material, but they are preferably formed from the interconnection of a number of separate components, as illustrated in FIG. 1. In the preferred embodiment shown, the body 2 is formed from three main components: a base member A, a collar member B located on the base member A, and a cap member C received on the collar member B. However, it should be understood that the present invention is not limited to this particular arrangement and assembly of components.

Figures 1, 2:
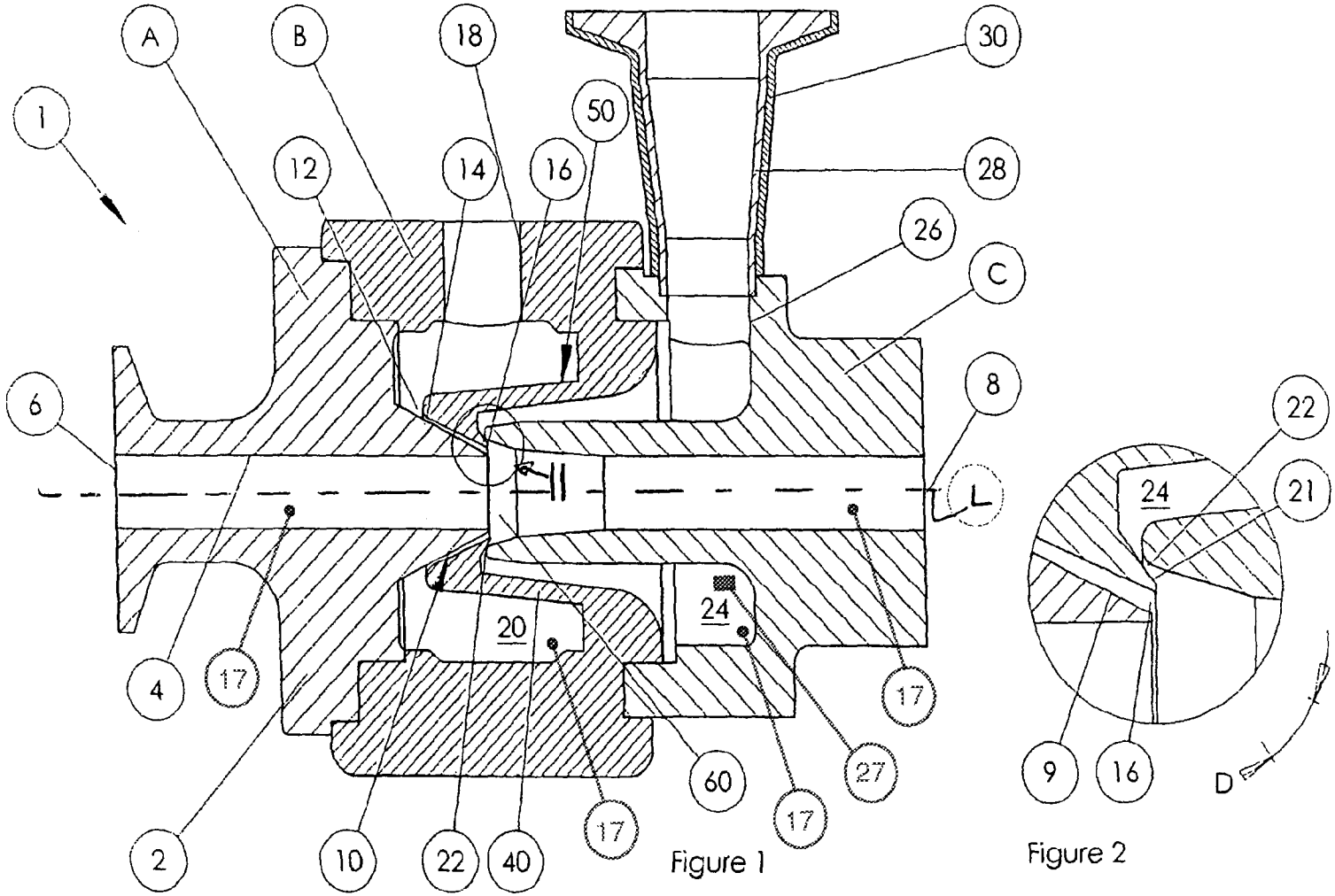
FIG. 1 is a vertical section through an apparatus for entraining a second process fluid in a first process fluid.
FIG. 2 is a detailed view of a portion of FIG. 1.

The body 2 has a fluid processing passage 4 extending longitudinally through the body 2, the processing passage 4 having an inlet 6 and an outlet 8. The processing passage 4 has a first cross sectional area at the inlet 6, and the cross sectional area of the passage 4 does not reduce below the first cross sectional area at any point along the axial length of the passage 4 to the outlet 8. In other words, whilst the cross sectional area of the processing passage 4 may increase at one or more locations along its length, any subsequent decrease in the cross sectional area of the passage 4 downstream of these locations will not fall below the first cross sectional area of the inlet 6. There are therefore no physical restrictions to fluid flow through the processing passage 4.

A nozzle 10 opens into the processing passage 4 at a location between the passage inlet 6 and passage outlet 8. The nozzle 10 is an annular nozzle which lies radially outwards of the passage 4, and consequently circumscribes, or surrounds, the passage 4. The nozzle 10 has a nozzle inlet 12, a nozzle throat 14 and a nozzle outlet 16. The nozzle throat 14 has a cross sectional area which is less than that of either the nozzle inlet 12 or the nozzle outlet 16. There is a gradual reduction in the cross sectional area of the nozzle 10 between the nozzle inlet 12 and the nozzle throat 14, and a gradual increase in the cross sectional area of the nozzle 10 between the nozzle throat 14 and the nozzle outlet 16. The nozzle inlet 12 is in fluid communication with an annular entrainment fluid chamber 20 located radially outward of the nozzle 10. Consequently, the entrainment fluid chamber 20 surrounds both the nozzle 10 and the passage 4. The chamber 20 is connectable to an entrainment fluid supply (not shown in FIG. 1) by an entrainment fluid supply passage 18 which extends to the exterior of the body 2 in a direction generally perpendicular to the processing passage 4. For the avoidance of doubt, references to "entrainment fluid" in this specification relate to a fluid which facilitates the entrainment of a second fluid in a first fluid, and not the fluid being entrained.

Also opening into the processing passage 4 at a location immediately downstream of the nozzle outlet 16 is a first port 22. The port 22 is preferably annular and radially outward of the passage 4 such that the port 22 also circumscribes, or surrounds, the passage 4. The port 22 is in fluid communication with an annular second fluid chamber 24 which surrounds the passage 4 downstream of the entrainment fluid chamber 20. As best seen in FIG. 2, the port 22 has a much smaller cross sectional area than that of the second fluid chamber 24. The second fluid chamber 24 is connectable to a second fluid supply (not shown in FIG. 1) by a second fluid supply passage 26 which extends to the exterior of the body 2 in a direction generally perpendicular to the processing passage 4. The second fluid supply passage 26 may be extended by a connector 28 which attaches to the body 2. The exterior of the connector 28 may be provided with an insulating layer 30 to maintain the temperature of the second process fluid.

The apparatus may further comprise a heating element located in the second fluid supply chamber.

A wall 40 is provided in the apparatus 1 in order to separate the entrainment fluid chamber 20 from the second fluid chamber 24. In the illustrated embodiment the wall 40 is preferably part of a cup portion 50 of the collar B, which locates in the body 2 and surrounds the processing passage 4. Between them the base A, collar B and cup C define the fluid chambers 20,24. The outer surface of the wall 40 at least partially defines the entrainment fluid chamber 20, and the inner surface of the wall 40 at least partially defines the second fluid chamber 24. As the cup portion 50 surrounds the processing passage 4 it is substantially co-axial with the processing passage 4, with the result that the wall 40 lies transverse to the entrainment fluid supply passage 18. Along with respective surfaces of the base A and cap C, the wall 40 acts as a funnel, channeling the contents of the entrainment fluid chamber 20 and second fluid chamber 24 to the nozzle 10 and port 22, respectively. As the wall 40 funnels the entrainment fluid in this way, any entrainment fluid entering the entrainment fluid chamber 20 from the supply passage 18 will come into contact with the wall 40 on its way to the nozzle 10. The wall 40 may be adapted so as to transfer heat received from any entrainment fluid in the entrainment fluid supply chamber 20 to the second process fluid in the adjacent second fluid chamber 24. For example, the wall may be formed from a material having a suitable degree of thermal conductivity.

Where the nozzle outlet 16 and fluid port 22 open into the passage 4, the cross sectional area of the passage 4 briefly increases to form a mixing chamber 60. Referring again to FIG. 2, the nozzle 10 and port 22 are annular openings which are both defined between respective inner and outer guide surfaces. Inner guide surfaces 9,21 partially define the nozzle 10 and port 22, respectively. As seen in FIG. 2, these inner surfaces 9,21 are at an angle D relative to one another. This angle D between the inner surfaces 9,21 is provided such that the respective fluid flows issuing from the nozzle 10 and port 22 will impinge upon one another in the mixing chamber 60. It has been determined that for optimum performance angle D is preferably in the range 15-25 degrees.

Figure 3:
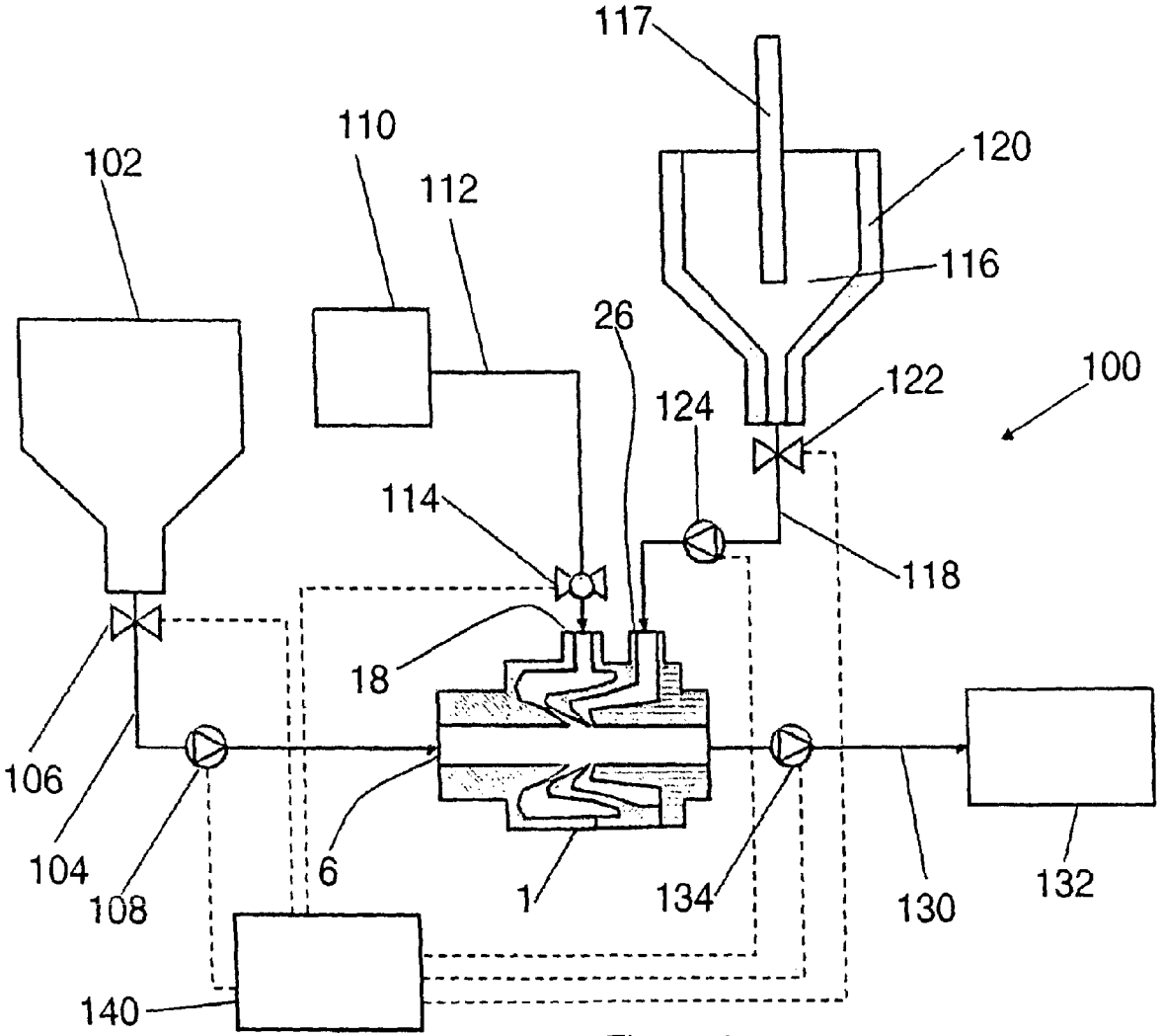
FIG. 3 is a schematic drawing of a processing system incorporating the apparatus of FIG. 1.

FIG. 3 schematically shows a processing system incorporating the apparatus 1. The system, generally designated 100, has a first process fluid vessel, or hopper, 102 which is fluidly connected to the processing passage inlet 6 of the apparatus 1 by a first supply line 104. A first control valve 106 controls fluid flow from the vessel 102 into the supply line 104. The supply line 104 may include a pump 108 to initiate flow of the first process fluid into the apparatus 1.

The system 100 also includes an entrainment fluid supply 110 which may, for example, be a steam generator. The entrainment fluid supply 110 is fluidly connected to the entrainment fluid supply passage 18 of the apparatus 1 by a second supply line 112. A second control valve 114 is located in the supply line 112 in order to control the flow of entrainment fluid into the apparatus 1.

A second fluid vessel, or hopper, 116 is connected to the second fluid supply passage 26 of the apparatus 1 by a third supply line 118. The second fluid vessel 116 may include a stirrer or paddle 117 in order to stir the contents of the vessel 116. The vessel 116 may have an insulating layer 120 in order to keep the second process fluid at a desired temperature. The second process fluid may be heated prior to entering the second fluid vessel 116, or else the vessel 116 may be provided with heating means such as, for example, a water jacket (not shown) which surrounds the vessel 116 and heats the contents thereof. Flow of the second process fluid from the vessel 116 to the apparatus 1 is controlled by a third control valve 122, and a pump 124 may also be provided in the third supply line 118 if the second process fluid is not to be supplied under gravity.

A processing line 130 is fluidly connected to the outlet 8 of the processing passage 4 in order to pass the fluids processed in the apparatus to either a storage vessel 132 or a further processing step downstream of the apparatus 1. An outlet pump 134 may be provided on the processing line 130 in order to assist with the downstream flow of fluid from the apparatus 1.

Each of the control valves and pumps provided in the system 100 is controlled by an electronic control unit (ECU) 140. The ECU 140 monitors the processing system 100 by way of a plurality of sensors 17 located at selected points inside the apparatus. Each sensor may monitor flow rate, and/or pressure, and/or temperature of the fluids within the system 100. The sensor locations include in the processing passage both upstream and downstream of the nozzle, in the entrainment fluid supply chamber and in the second fluid supply chamber. Based on signals received from the sensors the ECU can selectively adjust the control valves to vary the flow rates of the various fluids.

Figure 4B:
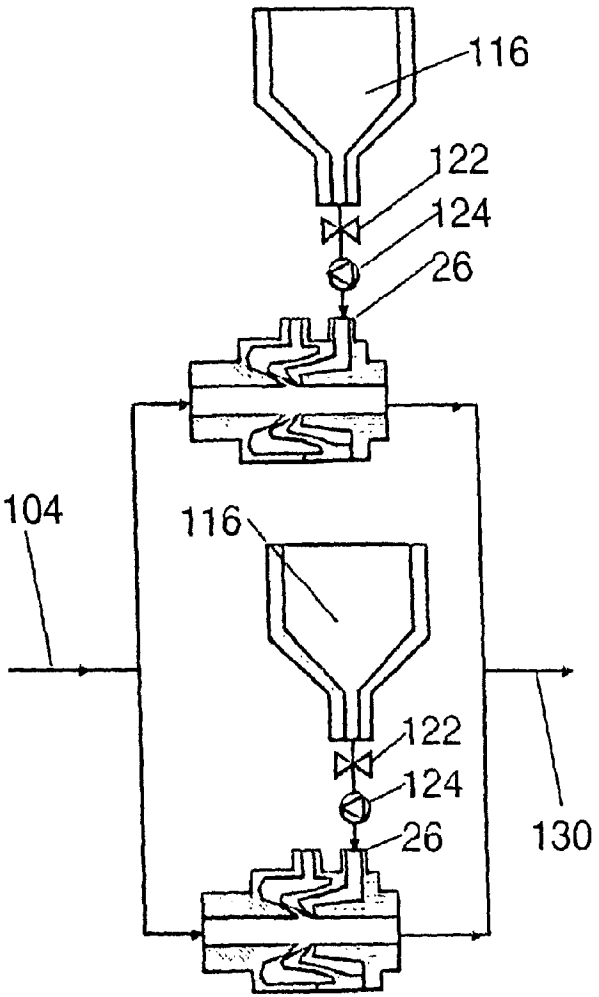
FIGS. 4(*a*) and 4(*b*) are schematic drawings showing a pair of the apparatus of FIG. 1 in series and parallel, respectively.
Figure 4A:
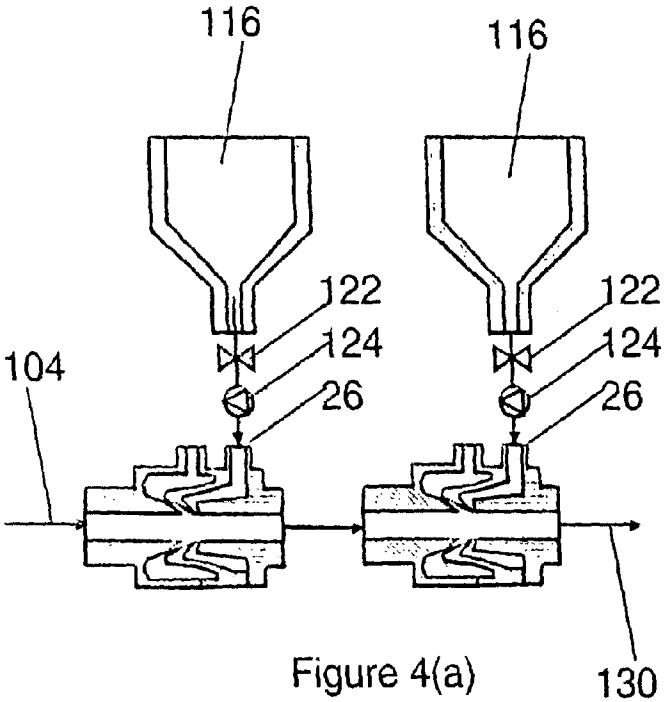

FIGS. 4(*a*) and 4(*b*) show schematic examples of how the apparatus 1 may be placed in series or in parallel in order to entrain one or more second process fluids into a first process fluid. Whilst a pair of apparatus are shown in FIGS. 4(*a*) and 4(*b*), it should be appreciated that any number of apparatus may be placed in series or parallel as shown. In both instances, each apparatus 1 has a separate second fluid vessel 116 which is connected to the second fluid supply passage 26 of each respective apparatus 1. Each second fluid vessel 116 may contain a different fluid to be entrained into the first process fluid, or all of the second fluid vessels 116 may contain the same fluid. The plurality of apparatus may share a single entrainment fluid source connected to their respective entrainment fluid supply passages, or else each apparatus may have a dedicated entrainment fluid source.

The operation of the apparatus and processing system will now be described, with particular reference to FIGS. 1 and 2. Initially, a first process fluid is introduced into the vessel 102.

The first process fluid may be water. Alternatively, the first process fluid may be an oil, an aqueous solution of salys, or water containing one or more structuring components such as, for example, Xanthan gum. When it is time for processing to commence the first control valve 106 is opened in order to allow the first process fluid to flow along the first supply line 104 into the apparatus 1. When present, the pump 108 is started to assist with the flow. The second control valve 114 controlling the supply of entrainment fluid to the apparatus 1 is also opened. Consequently, entrainment fluid flows from the entrainment fluid source 110 into the entrainment fluid supply chamber 20 of the apparatus 1. In this preferred embodiment, the entrainment fluid is a compressible gas. The gas is preferably steam and the entrainment fluid supply 110 is preferably a steam generator.

The second process fluid has a defined temperature T at which a phase change occurs in the second fluid. This temperature may be the temperature at which the second fluid changes from a solid to a liquid phase, or it may be a temperature above or below the helix coil transition temperature of a dispersed polymer, whereby the polymer is held in a desired state. The second process fluid is held in the second vessel 116 at a temperature $T_2$, where $T_2 \geq T$. As stated above, the second fluid may be heated in the vessel 116 to this temperature $T_2$, or else it may be heated elsewhere and then maintained at the desired temperature within the vessel 116. For successful entrainment the first process fluid usually must also be introduced to the apparatus at a temperature which is greater than or equal to T. However, for reasons that will be explained below, with the present invention the first process fluid can be introduced to the apparatus 1 at a temperature $T_1$, where $T_1 < T$.

Once the first and second control valves 106,114 have been opened, the third control valve 122 will also be opened in order to start the flow of the second process fluid from the second vessel 116 to the apparatus 1. If present, the pump 124 is activated to assist with the fluid flow. The second process fluid may be one of the following: a liquid formed from a material in a specific phase or state (e.g. a melted wax), a liquid containing a material which is in a specific state (e.g. gelatine in a high temperature molecular disordered state), or a liquid dispersion or suspension of particulates in a particular state (e.g. an emulsion of gel micro-beads).

Referring to FIG. 1, the entrainment and second process fluids will arrive in their respective supply chambers 20,24 in the apparatus 1. The heated entrainment fluid will heat up the wall 40 when entering the entrainment fluid chamber 20, and at least some of that heat may be transferred by the wall 40 to the second process fluid in the second fluid supply chamber 24. This heat transfer may ensure that the temperature $T_2$ of the second process fluid remains greater than or equal to T once in the apparatus 1.

The entrainment fluid flows from the supply chamber 20 into the nozzle inlet 12. The reduction and subsequent increase in cross sectional area through the nozzle 10 causes the entrainment fluid to accelerate through the nozzle 10 and a high velocity, preferably supersonic, jet of entrainment fluid is injected into the processing passage 4 from the nozzle outlet 16. At the same time, the first process fluid is flowing through the inlet 6 of the passage 4. As the entrainment fluid is injected into the passage 4 from the nozzle 10 it imparts a shearing force on the first process fluid as it passes the nozzle outlet 16. At the same time, a stream of the second process fluid is entering the process passage 4 from the fluid port 22. Due to the angle D between the respective inner surfaces 9,21 of the nozzle 10 and fluid port 22, the entrainment fluid entering the passage 4 through the nozzle 10 immediately impinges upon the second process fluid. The injected entrainment fluid imparts a shearing force on both process fluids upon entering the passage 4, and also generates a turbulent region in the mixing chamber 40. This combination of shear and turbulence leads to the at least partial atomisation of both the first and second process fluids. In other words, the injection of the entrainment fluid causes both process fluids to break down into very small particles and/or droplets and may cause some of the fluids present to evaporate. The differences in flow properties (e.g. velocity and pressure) between the entrainment fluid and the process fluids also leads to a momentum transfer from the high velocity entrainment fluid to the lower velocity process fluids, causing the process fluids to accelerate.

At the point of injection, the velocity of the entrainment fluid may be in the range where compressability effects occur. The velocity of the entrainment fluid may be at least Mach 0.3 and is preferably within a range of between Mach 0.7 and Mach 2.5. Most preferably the entrainment fluid is injected at a supersonic speed of between Mach 1.2 and Mach 2.5. The expansion of the entrainment fluid upon exiting the nozzle 10 causes an immediate pressure reduction in the mixing chamber 60 of the process passage 4. The injection of the entrainment fluid into the first and second fluids creates a dispersed phase of first and second process fluid droplets and particles in a continuous vapour phase of entrainment fluid and possibly some of the process fluid(s) (also known as a vapour-droplet flow regime) is created in the passage 4 and flows towards the outlet 8. The droplets and/or particles of the second process fluid are thus successfully entrained in the first process fluid.

As it moves towards the outlet 8 the fluid flow will begin to decelerate. This deceleration will result in an increase in pressure within the apparatus 1. At a certain point between the mixing chamber 60 and the passage outlet 8, the decrease in velocity and rise in pressure will result in a rapid condensation of the vapour present in the vapour-droplet regime. The point in the apparatus 1 at which this rapid condensation begins defines a condensation shockwave within the passage 4. A rise in pressure and consequent vapour-to-liquid phase change takes place across the condensation shockwave, with the flow returning to the liquid phase on the downstream side of the shockwave. The second process fluid is thus successfully drawn into and dispersed throughout the first process fluid.

The position of the shockwave within the passage 4 is determined by the supply parameters (e.g. pressure, density, velocity, temperature) of the various fluids, the geometry of the apparatus 1, and the rate of heat and mass transfer between the entrainment and process fluids. Where steam is used as the entrainment fluid the dryness fraction of the steam can also effect the performance of the apparatus.

Once the combined fluids leave the passage outlet 8, they are passed to either the storage vessel 132 or else a further processing step downstream of the apparatus 1. Where present, the pump 134 will assist in transporting the fluids downstream.

EXAMPLES

Test Example 1

Mixing of Water and Palm Oil

In the following example two materials were mixed using an apparatus and method as described above. Water was put in an upstream hopper fluidly connected to the processing passage inlet of the apparatus. Three tests were performed with water as the first process fluid at 50 deg C., 20 deg C. and 4.5 deg C. In each case approximately 1 liter of palm oil as the second process fluid was melted at a temperature of 60 deg C. and put into an insulated hopper fluidly connected to the second fluid supply passage of the apparatus. A steam supply was fluidly connected to the entrainment fluid supply passage.

In operation a valve was opened so as to allow water to flow from the upstream hopper into the apparatus and a second valve was opened to allow entrainment fluid to enter the passage via the nozzle. A pressure regulating valve controlled the entrainment fluid supply so as to maintain steam pressure at 8 bar. When stable flow was achieved, a third valve was opened allowing melted palm oil to flow from the insulated hopper into the passage. Flow of the melted palm oil was regulated via a 3.5 mm orifice plate across the hopper feed to the fluid port. Process conditions for this example produced a temperature rise across the apparatus ($\Delta T$) of 15 deg C. In other words, the exit temperature of the resultant product was 15 deg C. above that of the inlet temperature of the water. Samples of the product produced were taken downstream of the passage exit.

Examination of sample material from the three process runs established differences in the optical density of the dispersions formed via entrainment of the palm oil into water at the three temperatures listed above. In the first test with the water at 50 deg C. the inlet temperature $T_1$ was 10 deg C. above the start of melt temperature of the palm oil (T=40 deg C.), and the outlet temperature was 25 deg C. above the melt temperature T. Thus the palm oil was still in its molten liquid state at the end of process. Because of the lack of emulsifying or other stabilizing components in the system the liquid palm oil was free to phase separate and coalesce. A poured sample of the product was seen to have large coalesced oil droplets on its surface.

In the subsequent tests using water at 20 deg C. and 4.5 deg C., respectively, both were found to have outlet values below the melt point temperature T for the palm oil. For the 20 deg C. water the outlet temperature was 35 deg C., which is just below the palm oil melt point temperature T of 40 deg C. In the case of the water at 4.5 deg C., the temperature at the outlet was significantly lower at 19.5 deg C. It was observed that samples of the processed product obtained using 20 deg C. water and 4.5 deg C. water formed optically dense uniform materials indicating good dispersion formation. However, for the sample taken from the 4.5 deg C. water test some large (i.e. 0.5-3 mm) palm oil particulates were visible on the surface. These formed as the result of the metal of the apparatus being heavily cooled by the low inlet temperature of the water. In both the 20 deg C. and 4.5 deg C. examples, inclusion rates of the palm oil forming stable dispersions were estimated to be 100% and 95% respectively. For the 50 deg C. example inclusion of the palm oil into a dispersion with droplet sizes below 100 μm was below 50%.

Figure 5:
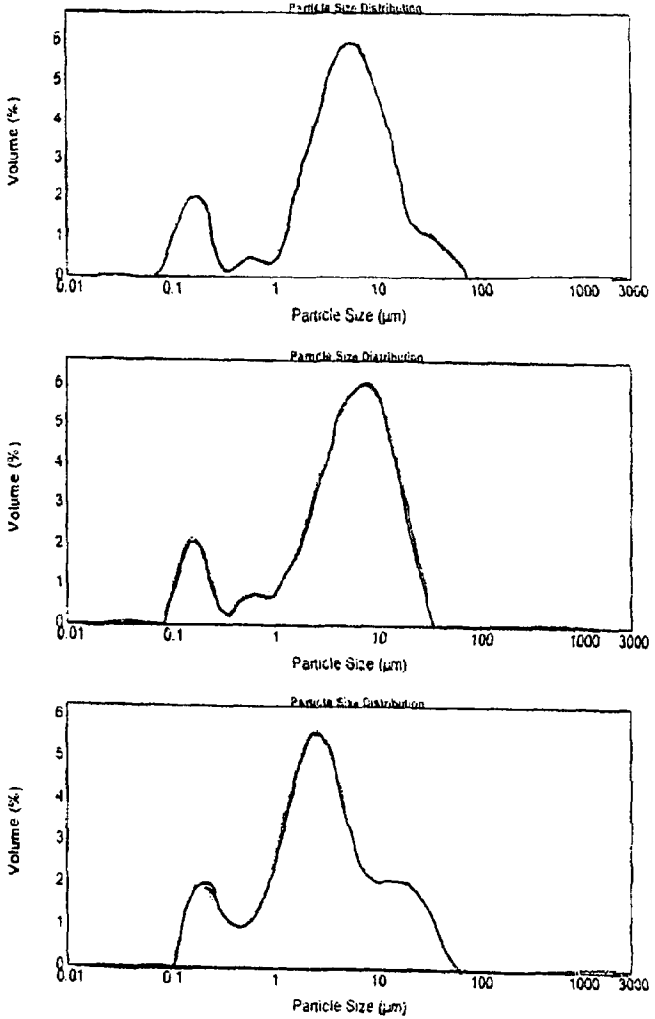
FIG. 5 shows graphs of particle size analysis on first test samples of fluid processed in accordance with the present invention.

A Malvern Mastersizer 2000 particle size analyser was employed to produce traces of the dispersed phase of the products obtained from the three tests, and these traces are shown in FIG. 5. In the 50 deg C. inlet sample represented by the upper graph, a clear shoulder can be seen in the 20-100 μm range reflecting the coalesced nature of the product. The trace in the middle graph represents the 20 deg C. inlet sample and is very similar but lacks the larger particle size shoulder of the 50 deg C. inlet material. In the lower graph representing the 4.5 deg C. sample there is a big shift down towards smaller particle sizes in the dispersion particularly in the sub-micron range.

From this example it can be concluded that entrainment of melted liquid palm oil into water having a final exit temperature below the melt point temperature T of the palm oil results in stable dispersions with very high or total inclusion of the lipid phase. It was also concluded that optimal dispersion of the palm oil in the water was achieved in the process of the present invention when the water was supplied to the apparatus at an inlet temperature $T_1$ below the melt temperature T of the palm oil.

The present invention utilises a fluid processing apparatus with a fluid port to allow a liquid in a particular phase or state, or a material within that liquid in a particular phase or state, to be fully mixed with, or incorporated into, another fluid having properties that would normally cause a phase or state change resulting in poor or undesirable product behaviour and functionality (e.g. precipitation, coalescence, or phase separation). Unlike in existing entrainment methods, the first process fluid does not need to be heated to or above the temperature T at which a phase change occurs in the second process fluid in order for the second fluid to be successfully entrained in the first fluid. In being able to combine these fluids in this way new processes, product formulations and structures are possible. This mixing and incorporation is made possible by the unique environment provided by direct combination of the fluids in the apparatus and method of the present invention and the very high speed at which the process takes place.

By introducing the second process fluid to be entrained directly into the apparatus immediately downstream of the nozzle, the second process fluid is instantaneously subjected to a combination of shear, turbulence, heat, acceleration, and the creation of a dispersed phase (liquid droplets) in a low pressure zone, followed by rapid deceleration and condensation. Thus the second process material is mixed and entrained with the first process fluid with very little thermal transfer and then re-condensed as a liquid or solid in a timescale where molecular movement of polymers, ions, molecules and solutes is extremely limited. As a result, events such as the formation of ionic bonds and hydrogen bonds, molecular alignment, and interfacial barriers such as surface tension are overcome or significantly reduced during the mixing of the two fluids. This ensures effective mixing and entrainment of the two process fluids.

As well as preparing novel and previously unobtainable materials via this process, entrainment of a second fluid being or containing a material in a particular state or phase into a first fluid may result in a more energy- and cost-efficient way of producing a conventional product. Only the second process fluid requires heating to a high temperature in order for it to be dispersed so the first process fluid can be introduced at a significantly lower temperature, thereby avoiding the detrimental effects that high temperatures may have on the first process fluid. Thermal input would be greatly reduced if the high temperature component is introduced to the lower temperature bulk formulation in the manner provided by the present invention.

The first process fluid may be supplied directly from an earlier process upstream of the apparatus, rather than from a first fluid vessel. Furthermore, the system shown in FIG. 3 may incorporate a recirculation loop and associated diverter valves, which may selectively recirculate the process fluids from downstream of the apparatus to upstream of the apparatus for further passes through the apparatus.

Where the system or manufacturing process is a batch process the first fluid vessel and the second fluid vessel may be filled with the appropriate amounts of fluid at the start of the batch process. However, if the manufacturing process is to be continuous or in-line the vessels may both be continuously fed with the appropriate materials by pipework from another manufacturing stage, or they may be replaced by pipework supplying a continuous feed of the appropriate fluids.

One or both fluid supply vessels may be provided with temperature control means for heating or cooling the respective process fluids to a desired temperature prior to processing. The vessels may also include controlled dosing arrangements for maintaining desired pH, ionic strength and/or co-solute levels in the process fluid(s).

The second process fluid may be supplied to the fluid port as a continuous flow, or alternatively may be supplied as a pulsed, or intermittent, feed. The second process fluid may comprise a suspending, gelling or viscosifying material in a particular phase or state. The second process fluid may also contain neutral and/or functional particulates such as fibres, powders, ground minerals, crystals, pharmaceutical compounds and cells.

Whilst it is preferable for the processing passage to have a cross sectional area at its inlet which does not reduce at any point along its length, the invention is not limited to this specific geometry. An alternative embodiment of the apparatus may comprise a processing passage where the cross sectional area is less than that of the inlet at one or more locations along its length. Similarly, the present invention is not limited to an apparatus where the entrainment fluid nozzle has an internal geometry where a throat portion has a cross sectional area less than that of either the nozzle inlet or nozzle outlet. An alternative embodiment may have a entrainment fluid nozzle without a throat portion, where the nozzle outlet has a reduced cross sectional area when compared to the nozzle inlet.

Figure 6:
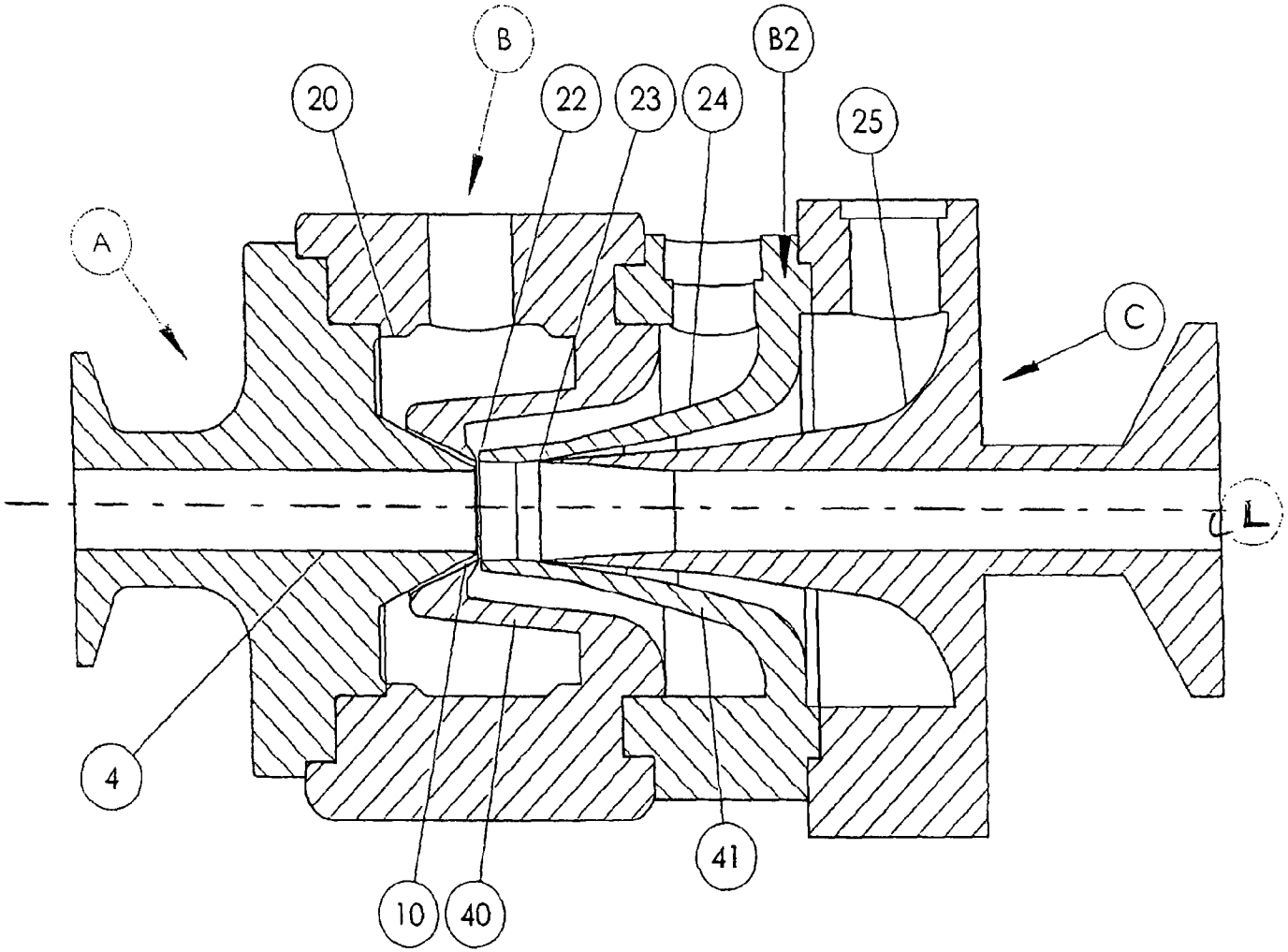
FIGS. 6 and 7 show vertical sections through second and third embodiments of an apparatus for entraining a second process fluid in a first process fluid.
Figure 7:
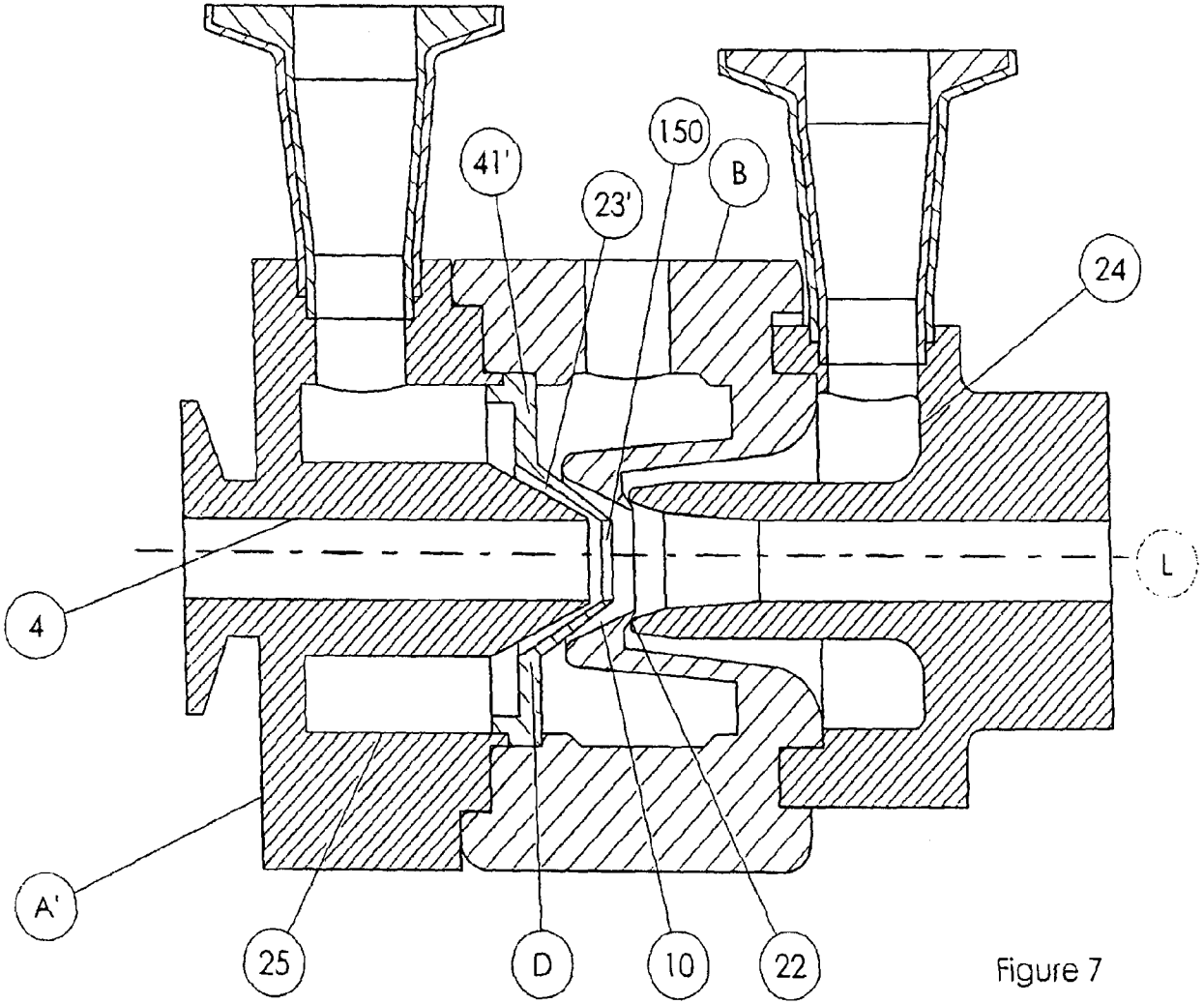

The apparatus may have more than one fluid port, as shown in FIGS. 6 and 7 which illustrate second and third embodiments of the apparatus, respectively. In the second embodiment shown in FIG. 6, the apparatus comprises first and second fluid ports 22,23 opening into the processing passage 4 downstream of the nozzle 10. An entrainment fluid supply chamber 20 is in fluid communication with the nozzle 10, and second and third fluid supply chambers 24,25 are in fluid communication with their respective fluid ports 22.23. The three chambers 20,24,25 are separated from one another by first and second wall members 40,41, respectively. The first wall member 40 at least partially defines both the entrainment fluid supply chamber 20 and the second fluid supply chamber 24, whilst the second wall member 41 at least partially defines both the second and third fluid supply chambers 24,25. The second wall member 41 may be provided on a supplementary collar member B2 which is sandwiched between the first collar member B and the cap member C, whereby the various chambers 20,24,25 are defined between the base member A, collar members B,B2 and the cap member C. The third supply chamber 25 may be connected to the same fluid supply as the second fluid supply chamber 24, or may be connected to a supply of a third fluid. Other than fluid also being drawn into the processing passage 4 via an additional fluid port 23, the second embodiment of the apparatus operates in substantially the same manner as the first embodiment described above.

The third embodiment shown in FIG. 7 also introduces a second fluid port 23', but in this embodiment the second fluid port 23' is upstream of the nozzle 10 and first fluid port 22. In other words, the nozzle 10 is sandwiched between the fluid ports 22,23'. In the third embodiment, the base member A' is modified to incorporate an annular third fluid supply chamber 25' through which fluid passes to the port 23'. An orifice plate D having a central orifice 150 is attached to the base member A such that the orifice 150 is co-axial with the passage 4. When the collar member B is attached to the base member A over the orifice plate D, a portion of the plate D acts as the second wall member 41' and at least partially defines both the entrainment and third fluid supply chambers 20,25'. The third supply chamber 25' may be connected to the same fluid supply as the second supply chamber 24, or may be connected to a supply of a third fluid. Other than fluid also being drawn into the processing passage 4 via the second fluid port 23', the third embodiment of the apparatus operates in substantially the same manner as the first embodiment described above.

Figure 8:
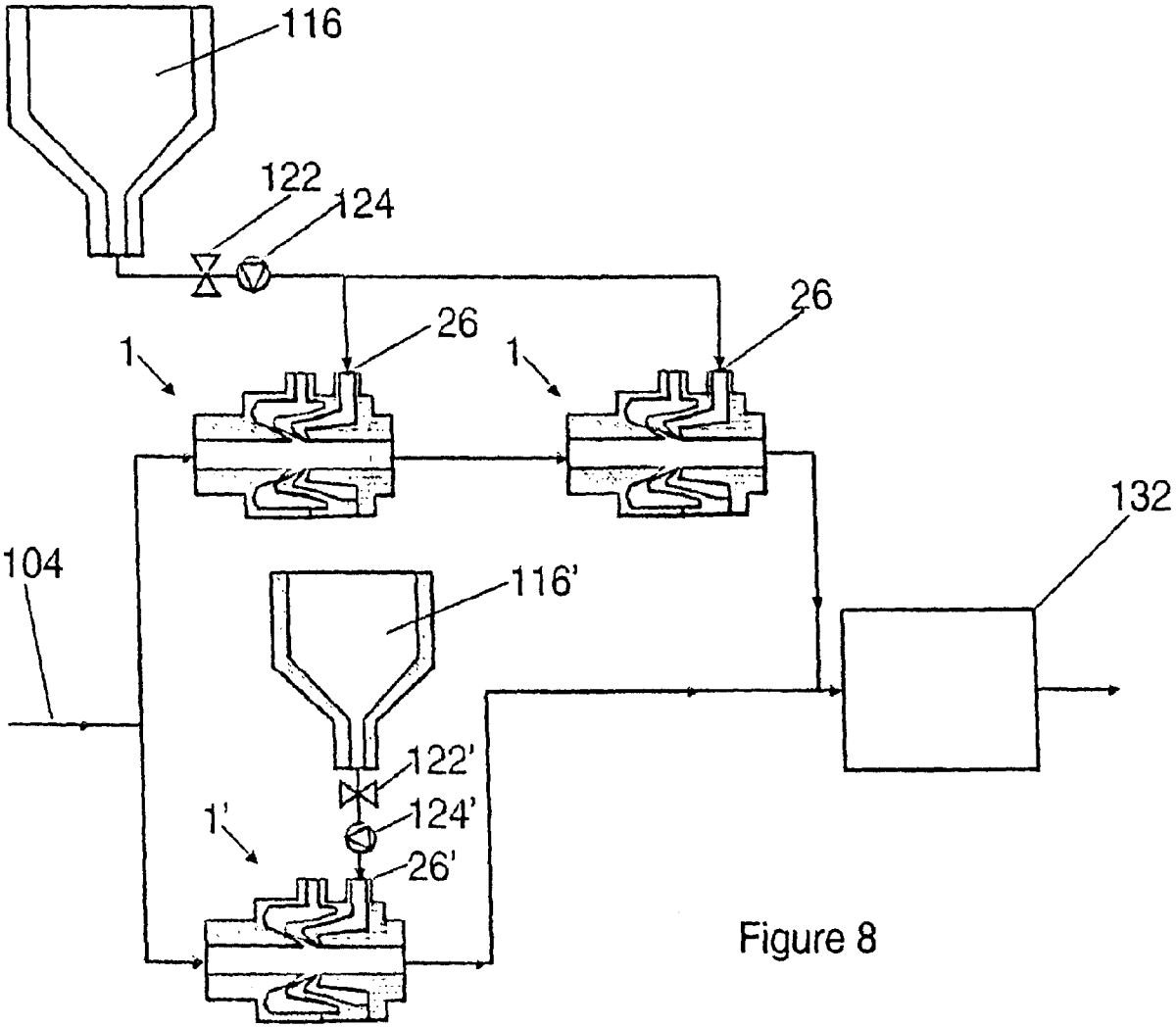
FIGS. 8 and 9 show second and third embodiments of a processing system incorporating the entrainment apparatus.

In some instances, different types of transport fluid, with their own respective entrainment fluid source, may be used at different stages in the process. In some embodiments, where a single second process fluid is being entrained into the first process fluid via two or more apparatus, there may be a single second fluid vessel connected to several apparatus, which may be in series or in parallel. A second embodiment of the processing system incorporating this arrangement is shown schematically in FIG. 8. In this system a pair of apparatus 1 in series are arranged in parallel with a single apparatus 1'. Both sets of apparatus 1,1' receive a supply of a first processing fluid through a first supply line 104. The pair of apparatus 1 in series receive a second fluid from a shared second fluid vessel 116. Control of the flow of the second fluid from the vessel 116 to the respective second fluid supply passages 26 of the apparatus 1 is achieved via a control valve 122 and pump 124. The single apparatus 1' has a separate supply vessel 116' connected to its second fluid supply passage 26', and that vessel 116' may supply the same fluid as the vessel 116 or else may supply a different fluid. Again, flow control from the vessel 116' is achieved by way of a control valve 122' and pump 124'. Although not shown in FIG. 8, it should be appreciated that each apparatus 1,1' is also connected to a source of entrainment fluid. The entrainment fluid may be provided to each apparatus 1,1' from a single source, or each apparatus 1, 1' may have a dedicated source of entrainment fluid. Each apparatus 1, 1' will operate in substantially the same manner as described above, with the processed fluid passing from the apparatus 1,1' to a storage vessel 132 or a further processing step downstream.

The supply to the respective apparatus may be gravity fed, or pumped. Each fluid port may have a dedicated control valve and pump or there may be a single control valve and pump controlling flow to a number of fluid ports.

Figure 9:
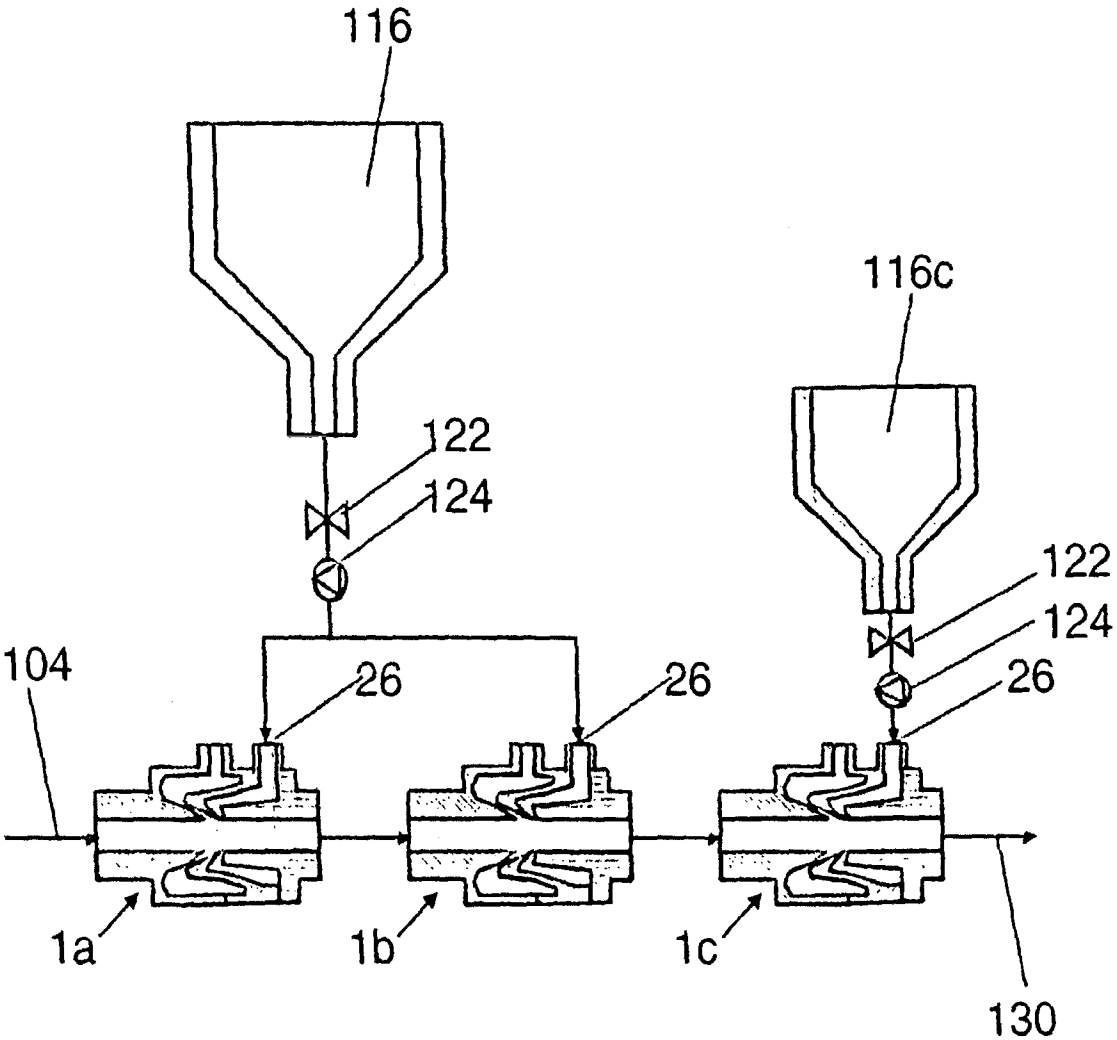

FIG. 9 shows a third embodiment of the processing system, in which a number of apparatus 1*a*,1*b*,1*c* are employed in series with one another. The first apparatus 1*a* in the series receives a supply of the first process fluid via first supply line 104. The first and second apparatus 1*a*,1*b* in the series receive a supply of the second process fluid from a single second fluid supply vessel 116, with a control valve 122 and pump 124 controlling the flow of the second fluid to the respective second fluid supply passages 26 of each apparatus 1*a*,1*b*. Although not shown in FIG. 9, each apparatus 1*a*,1*b*,1*c* is connected to a supply of a suitable entrainment fluid as described above.

Once the processing has taken place in the first and second apparatus 1*a*,1*b*, the processed fluid passes into the processing passage 4 of the third apparatus 1*c*. The third apparatus has a separate second fluid supply vessel 116*c* which may supply a different fluid for entrainment into the fluid entering the apparatus 1*c*. Again, a control valve 122 and pump 124 control flow of this fluid into the third apparatus 1*c*. The entrainment fluid may be provided to each apparatus 1*a*,1*b*,1*c* from a single source, or each apparatus 1*a*,1*b*,1*c* may have a dedicated source of entrainment fluid. Each apparatus 1*a*,1*b*, 1*c* will operate in substantially the same manner as described above, with the processed fluid passing from the apparatus to a storage vessel or further processing step downstream via processing line 130.

Test Example 2

Ion Mediated Phase Transition

A second test was also conducted using the apparatus and method of the present invention to entrain a final gelling concentration (1% w/w) of low methoxy apple pectin into a process flow of 0.25 or 0.025 molar calcium chloride dihydrate. A 4% (w/w) pectin dispersion was prepared by slow addition of the dry powder to deionised water agitated by a floor standing overhead stirrer. The water pectin mix was allowed to stir for a further 30 minutes to ensure full hydration of the polymer. The final batch temperature for entrainment was 18° C. Each experimental run utilised 15 L of pectin dispersion.

0.25M and 0.025M calcium chloride solutions were prepared by adding the required mass of salt to deionised water and stirred for 30 minutes prior to use. Each experimental run utilised 45 L of the calcium chloride solution. The batch temperature was 17° C.

The 4% (w/w) pectin dispersion (second fluid) was entrained into the calcium chloride solutions (first fluid) via the apparatus and method of the present invention. The calcium chloride solutions were pumped at a process flow rate of 43 L/minute with the pectin dispersion entrained at a rate giving a concentration of 1% on mixing with the solutions. Steam was utilised as the entrainment fluid and was delivered to the apparatus at a pressure of 8.5 bar and a flow rate of 100 Kg/hour. Three experimental conditions were tested where the second fluid pectin dispersion was entrained into water as well as 0.025M and 0.25M calcium chloride solutions. On each occasion the inlet temperature of the first fluid was 18° C. and final outlet temperature of the processed product was 30° C. Thus the apparatus had a working ΔT of 12° C. Samples of product from each experiment were collected for particle size analysis.

Figure 10:
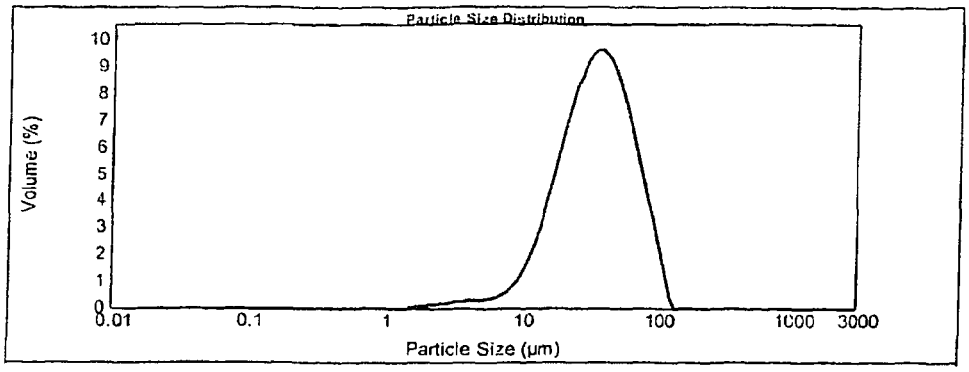
FIGS. 10 and 11 show graphs of particle size analysis on second test samples of fluid processed in accordance with the present invention.

The pectin solution entrained into 0.25M calcium chloride solution underwent a sol-gel transition on rapidly mixing during entrainment in the apparatus. The resulting product contained small structured gel domains. A particle size measurement for this material was made on a Malvern Mastersizer 2000 particle analyser and is shown in FIG. 10. The gel domains formed were in the range of 16-75 microns with the d(0.5) around 35 microns. The 0.25 molar calcium chloride provided sufficient divalent ions to rapidly stabilise the pectin and change the pectin's state from sol to gel on mixing in the apparatus.

Figure 11:
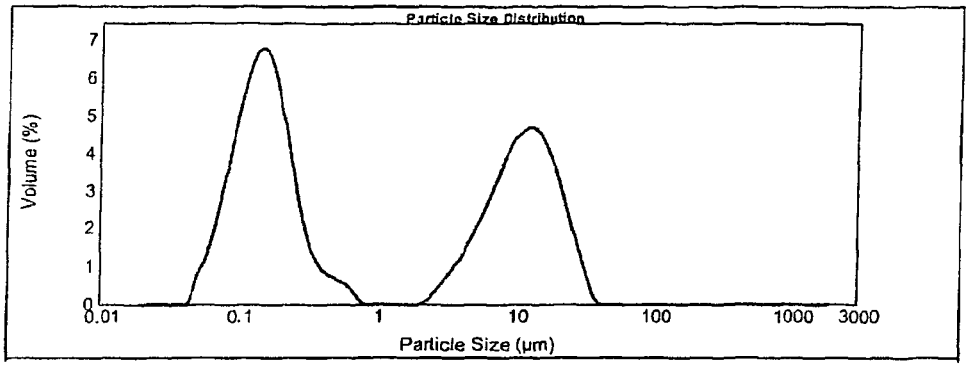

Entraining the pectin into 0.025 molar calcium chloride did not result in a significant formation of gel domains. The particle size measurement shown in FIG. 11 details a bimodal dispersion of particulates. This concentration of calcium salt is not sufficient to significantly stabilise the pectin gel. The two populations recorded in the particle size distribution of FIG. 11 are significantly smaller than that of the 0.25 m calcium chloride example in FIG. 10. It should also be noted that in order to achieve an acceptable reading with the particle analyser 25 mls of this material had to be added as opposed to 3 mls of the 0.25M product. Thus much of the pectin in this product was still in dispersion (sol phase) and therefore there had not been a major change in material state due to the low ionic concentration.

Finally, entraining the pectin dispersion into water did not result in the formation of gel domains. It was not possible to add enough of the product to the particle analyser in order to get an acceptable reading. By entraining under these conditions the pectin had not experienced a phase change, merely dilution, and therefore was still in the sol state.

Using a number of apparatus in series or in parallel may be a method by which larger amounts of a single second process fluid are entrained into the first process fluid, or may be used to gradually add a plurality of different types of second process fluid as a formulation is gradually manufactured. The manufacturing process may also incorporate other processing apparatus as required, examples of which may include powder fluid ports, in-line feed ports for adding additional fluids, or mixing and blending devices. Where a processing line requires a number of apparatus in series, an alternative solution would be an alternative design of apparatus which consists of a single unit into which the appropriate number of nozzles, fluid ports, and associated supply chambers and passages have been incorporated. For example two apparatus in series could be replaced by a single apparatus having a first nozzle and first fluid port opening into the processing passage, and a second nozzle and second fluid port opening into the same passage downstream of the first nozzle and fluid port.

Where the processing system includes a number of entrainment apparatus in series, the system may further comprise a heat exchanger or the like in the process line between each apparatus in order to control the temperature of the process fluids therein. This may control the temperature of the final product in order to prevent its temperature from rising above T and so undesirably causing a phase change of the second process fluid to occur. Furthermore, the apparatus itself might incorporate insulation or temperature controllers so as to control the temperature of the product(s) as they pass through the apparatus. Such controllers may be located in one or more of the main process passage, the entrainment fluid and second fluid supply chambers, and the entrainment fluid and second fluid supply passages. The temperature controllers may be used to heat or cool the various fluids and products at various stages through the system. Such temperature control devices may comprise one or more of the following, as examples insulation or lagging, temperature controlled water-jackets, heat exchangers, heating elements, heated vessels, jacketed vessels, refrigeration systems, or cooling systems.

The entrainment fluid used in the preferred embodiment is steam. However, non-limiting examples of other suitable entrainment fluids are gases such as carbon dioxide, compressed air and nitrogen.

Where steam is used as the entrainment fluid, one or more moisture traps or heaters may be located upstream of the nozzle in order to monitor the quality (e.g. dryness fraction) of the steam. The control system can be adapted to control the steam generator in order to vary the quality of steam being produced, and hence the performance of the apparatus.

The second fluid may have a temperature range within which the change of phase and/or state will occur as opposed to one specific temperature. This may be the case when, for example, the second fluid contains a mixture of polymers. In such a fluid the transition begins to take place when the temperature of the second fluid either rises above a minimum transition temperature $T_{min}$ or falls below a maximum transition temperature $T_{max}$. In this case the second fluid would preferably be held in the second fluid supply chamber at a temperature greater than $T_{max}$ or at very least greater than $T_{min}$.

Some materials exhibit more than one phase change. For some products it may be preferential to cause one of the phase changes, whilst preventing the material from passing through another phase change (e.g. by controlling the temperature and pH or ionic concentration of the various fluids). In other processes, one may want to drive the material through more than one phase change. An example of a material that has two phase changes is Gellan, which has both a temperature-driven helix-coil transition and an ionic concentration driven gel-sol transition. One might choose to entrain a second process fluid containing Gellan which is at a temperature above T and a concentration below C, into a first process fluid which is at a temperature below T and a concentration above C. The change in ionic concentration may be achieved by, for example, mixing calcium carbonate at an appropriate concentration into the first process fluid. When the two process fluids mix in the apparatus of the present invention, the Gellan may then go through both a cooling event below temperature T and an ionic concentration change above concentration C on mixing with the first process fluid thereby going through both the helix-coil transition and the gel-sol transition.

These and other modifications and improvements may be incorporated without departing from the scope of the present invention.

The invention claimed is:

1. A method of entraining a second fluid in a first fluid, the method comprising:

supplying the first fluid to a processing passage having an inlet and an outlet;

supplying an entrainment fluid to a nozzle which opens into the processing passage intermediate the passage inlet and the passage outlet;

providing the second fluid that will undergo a change of phase and/or state when added to the first fluid, and supplying the second fluid to a first port opening into the processing passage downstream of the nozzle; injecting the entrainment fluid from the nozzle into the processing passage so as to form a dispersed phase of the first and second fluids in a continuous vapour phase, wherein the second fluid is in the liquid phase when supplied to the first port and will at least partially solidify or crystallise when added to the first fluid; and condensing the vapour phase downstream of the entrainment fluid nozzle.

2. The method of claim 1, wherein the second fluid has a predetermined temperature T at which the change of phase and/or state will occur, and the second fluid in a second fluid supply chamber has a temperature $T_2$, where $T_2 \geq T$, and the first fluid supplied to the processing passage has a temperature $T_1$, where $T_1 < T$.

3. The method of claim 1, wherein the second fluid has a predetermined ionic concentration C such that the second fluid is in a specific phase and/or state in a second fluid supply chamber, and the first fluid supplied to the processing passage has an ionic concentration d which is greater than or less than C.

4. The method of claim 1, wherein the second fluid has a predetermined pH level P such that the second fluid is in a specific phase and/or state in a second fluid supply chamber, and the first fluid supplied to the processing passage has a pH level Pi which is greater than or less than P.

5. The method of claim 2, wherein the entrainment fluid is supplied to the nozzle from an entrainment fluid supply chamber, and the second fluid is supplied to the first port from the second fluid supply chamber, wherein the entrainment and second fluid supply chambers are separated from one another by a wall member which at least partially defines both chambers, and wherein the method further comprises maintaining the temperature $T_2$ of the second fluid in the second fluid supply chamber by transferring heat from the entrainment fluid to the second fluid through the wall member.

6. The method of claim 1, wherein the entrainment fluid is a gas selected from the group comprising steam, carbon dioxide, compressed air, and nitrogen.

7. An apparatus for entraining a second fluid in a first fluid, the apparatus comprising:

a fluid processing passage having an inlet connectable to a source of the first fluid, and an outlet;

a nozzle circumscribing the processing passage and opening into the processing passage intermediate the inlet and the outlet; and a first port opening into the processing passage downstream of the nozzle;

wherein the apparatus further comprises an entrainment fluid supply chamber in fluid communication with the nozzle, and a second fluid supply chamber in fluid communication with the first port; and wherein the chambers are separated from one another by a wall member which at least partially defines both the entrainment fluid supply chamber and the second fluid supply chamber, wherein the entrainment and second fluid supply chambers are annular and located radially outward of the processing passage, and wherein the entrainment fluid supply chamber is located radially outward of the second fluid supply chamber.

8. The apparatus of claim 7, wherein the wall member is adapted to allow heat transfer from the entrainment fluid supply chamber into the second fluid supply chamber.

9. The apparatus of claim 7, wherein the apparatus may further comprise a heating element located in the second fluid supply chamber.

10. The apparatus of claim 7, wherein the inlet of the processing passage has a first cross sectional area, and the cross sectional area of the passage does not reduce below the first cross sectional area at any point between the passage inlet and the passage outlet.

11. The apparatus of claim 7, wherein the nozzle has a nozzle inlet, a nozzle outlet and a nozzle throat portion intermediate the nozzle inlet and nozzle outlet, and the throat portion has a cross sectional area which is less than that of either the nozzle inlet or nozzle outlet.

12. The apparatus of claim 7, wherein the first port is an annular port circumscribing the processing passage.

13. A system comprising:

an apparatus in accordance with claim 7;

a first fluid supply vessel in fluid communication with the process passage inlet;

an entrainment fluid supply in fluid communication with the entrainment fluid supply chamber;

a second fluid supply vessel in fluid communication with the second fluid supply chamber;

a plurality of control valves controlling fluid flow from the entrainment fluid supply and vessels to the apparatus;

a plurality of sensors located in the process passage and supply chambers; and an electronic control unit adapted to selectively open and close the control valves in response to signals from the plurality of sensors.

* * * * *